US008555911B2

(12) United States Patent
Heil

(10) Patent No.: US 8,555,911 B2
(45) Date of Patent: Oct. 15, 2013

(54) METHOD AND APPARATUS FOR WATER SURGE PROTECTION

(76) Inventor: Howard Heil, Downers Grove, IL (US)

( * ) Notice: Subject to any disclaimer, the term of this patent is extended or adjusted under 35 U.S.C. 154(b) by 539 days.

(21) Appl. No.: 12/195,833

(22) Filed: Aug. 21, 2008

(65) Prior Publication Data

US 2009/0050211 A1 Feb. 26, 2009

Related U.S. Application Data

(60) Provisional application No. 60/957,880, filed on Aug. 24, 2007.

(51) Int. Cl.
*F17D 1/00* (2006.01)

(52) U.S. Cl.
USPC ..... 137/13; 137/207; 137/236.1

(58) Field of Classification Search
USPC ..... 137/13, 207, 236.1; 138/26, 30
See application file for complete search history.

(56) References Cited

U.S. PATENT DOCUMENTS

| | | | | |
|---|---|---|---|---|
| 2,354,201 | A * | 7/1944 | Dand | 138/30 |
| 2,504,424 | A * | 4/1950 | Kraak | 138/30 |
| 2,809,665 | A * | 10/1957 | Crowe | 138/30 |
| 3,422,853 | A * | 1/1969 | Schmid | 138/30 |
| 4,442,858 | A * | 4/1984 | Everett | 137/207 |
| 4,819,445 | A * | 4/1989 | Scherer | 62/238.3 |
| 5,218,987 | A * | 6/1993 | Heil | 137/207 |
| 5,765,876 | A * | 6/1998 | Bridges | 285/15 |
| 6,543,485 | B2 * | 4/2003 | Henry et al. | 138/30 |
| 7,472,720 | B2 * | 1/2009 | Young | 138/30 |

* cited by examiner

*Primary Examiner* — Kevin Lee
(74) *Attorney, Agent, or Firm* — McAndrews, Held & Malloy, Ltd.

(57) ABSTRACT

A method and apparatus protecting a water distribution system from main breaks caused by sudden pressure spikes in the distribution system. A surge suppressor apparatus may include a surge suppressor tank. The surge suppressor tank may be a hollow, cylindrical container adapted to retain liquid. The surge suppressor apparatus may also include a tee pipe integrally formed to the suppressor tank. The tee pipe is sized so that it connects to an underground supply pipe. End caps may be integrally formed to the suppressor tank. The end caps create an airtight seal in the surge suppressor tank.

14 Claims, 5 Drawing Sheets

FIG.4A
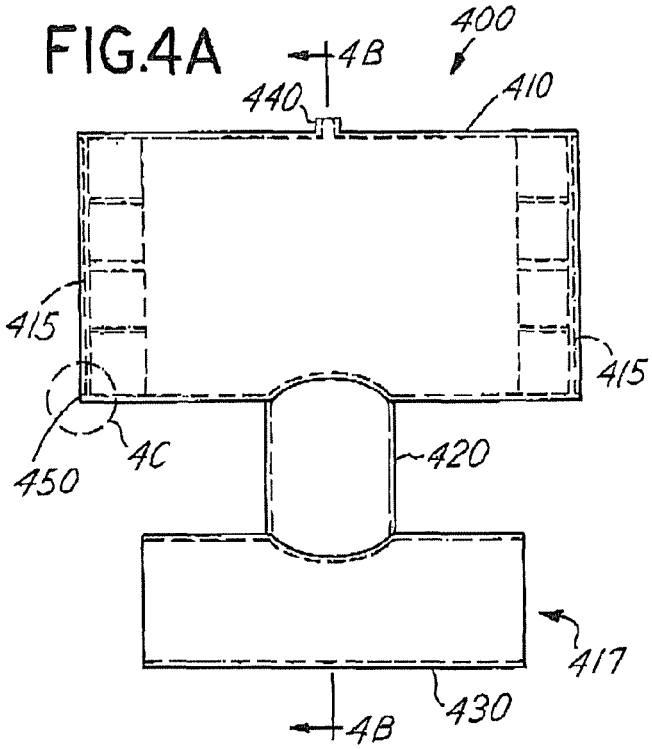
FIG.4B
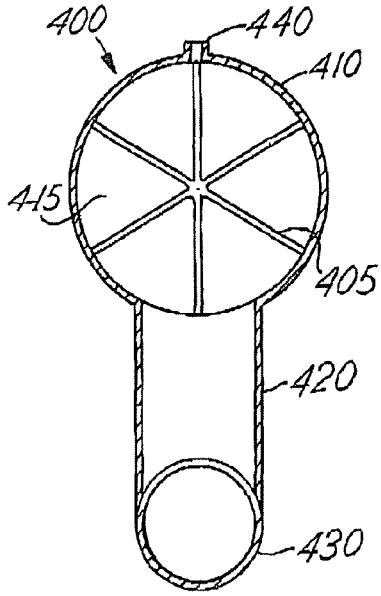
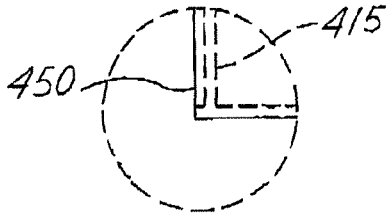
FIG. 4C

METHOD AND APPARATUS FOR WATER SURGE PROTECTION

CROSS-REFERENCE TO RELATED APPLICATIONS/INCORPORATION BY REFERENCE

This application claims priority to Provisional Patent Application No. 60/957,880 having a filing date of Aug. 24, 2007, entitled "Method and Apparatus for Water Surge Protection," which is hereby incorporated by reference herein in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the present invention relate to water surge protection. More specifically, certain embodiments of the present invention provide for protecting a water distribution system from main breaks caused by sudden pressure spikes in the distribution system.

BACKGROUND OF THE INVENTION

A conventional city water distribution system is a network of pumps, pipelines, storage tanks, fire hydrants, and the like. The water main pipes are typically buried underground, in dedicated easements. A water distribution system delivers quantities of water at pressures sufficient for supply customers and firefighting equipment while avoiding excess pressure which could cause leaks and pipeline breaks. Water customer services are attached to the water main, and water is carried from the water distribution system into customers' homes or businesses.

Fire hydrants are typically fed by an underground supply pipe and typically include underground shut-off valves which control the flow of water to each hydrant. Fire hydrants contain manually operable valves which are operated by a fireman to release water from the underground supply pipe in an event of a fire or during a training exercise. Also, hydrants may be opened by city workers or others in order to clear sedimentation from the water mains. Typically, the hydrant valve is located underground. Except in tropical climates where the ground does not freeze, it is generally necessary to bury below the frost line all of the parts of the system which normally retain standing water or slowly moving freezable liquids. A drain valve is normally open, draining the hydrant barrel while the hydrant valve is closed.

The hydrant valve is usually controlled by a stem extending vertically from the buried valve and passing through the top of the hydrant. A shut-off auxiliary valve, which is separate from the hydrant valve, is usually provided with an access conduit extending vertically to a removable access cover located at ground level adjacent to the hydrant. The access cover is removed and a removable wrench, commonly known as a valve key, is inserted through the access conduit to operate the shut-off valve.

A water surge can be a severe problem in a distribution system. A water surge results when a valve at one point in a distribution system is opened or shut suddenly, creating shockwaves of moving water upstream and downstream of that valve. In addition, when a pump or other source providing pressure on the water in the main is actuated, additional flows are created or diminished. Since water is essentially incompressible, it does not absorb the energy of the shockwave, but transmits it throughout the distribution system to nearby or distant parts of the system which are not isolated behind a closed valve. The turbulence created by the shockwave seeks a release point. Elevated water tanks are common release points but often are not close to the source of turbulence. Without a planned release point, the turbulence may create its own release point at a weak point in the distribution system, causing a water main break or other damage to the distribution system.

A water surge is capable of parting joints, breaking water mains and other components of the system. Since the system is mostly buried, occasionally time is required to pinpoint the damage area and then correct the resulting damage. The water escaping from the damaged system can cause a pressure failure, a pavement collapse, or other damage. It is sometimes very dangerous to repair. The danger occurs with trench cave-ins during working and with the possibility of breaking, or causing an explosion of a gas or other utility line.

Water main breaks are a costly and time consuming problem for municipalities. A system and method for water surge protection may minimize the frequency of water main breaks. Thus, there is a need for a system and method for protecting a water distribution system from main breaks caused by sudden pressure spikes in the distribution system.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A system and method for water surge protection is provided for protecting a water distribution system from main breaks caused by sudden pressure spikes in the distribution system.

These and other advantages, aspects and novel features of the present invention, as well as details of an illustrated embodiment thereof, will be more fully understood from the following description and drawings.

BRIEF DESCRIPTION OF SEVERAL VIEWS OF THE DRAWINGS

FIG. 4*a* is a side view of an embodiment of a surge suppressor tank apparatus, in accordance with the present invention.

FIG. 4*b* is a front sectional view of an embodiment of a surge suppressor tank apparatus, in accordance with the present invention.

FIG. 4*c* is an exploded view of a portion of the surge suppressor tank apparatus of FIG. 4*a*, in accordance with the present invention.

Figure 1:
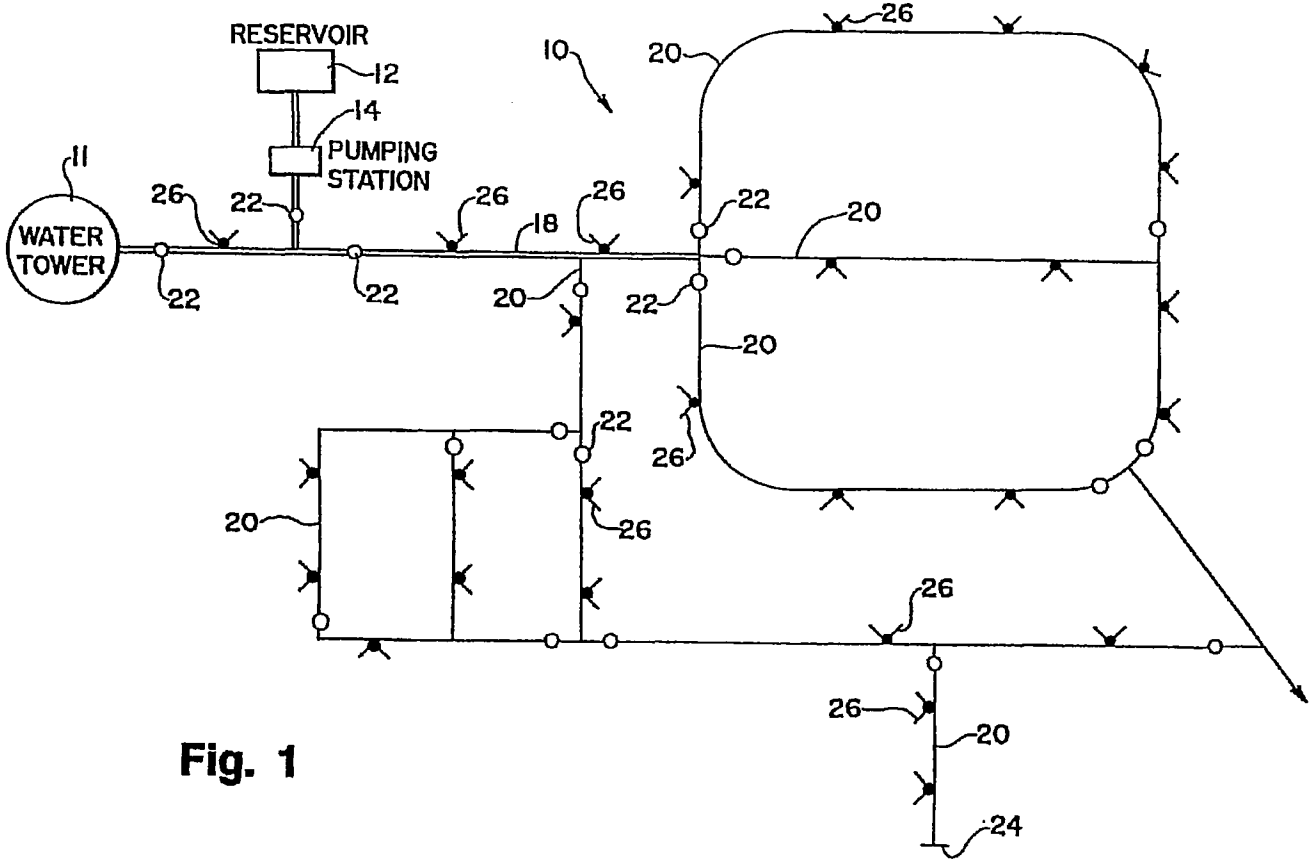
FIG. 1 is a schematic view of a water distribution system or a portion thereof, in accordance with an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Certain embodiments of the invention may be found and/or used in a system and method for water surge protection. More specifically, certain embodiments relate to protecting a water distribution system from main breaks caused by sudden pressure spikes in the distribution system.

Referring to FIG. 1, a small water distribution system, or a portion thereof, generally indicated at 10, comprises a water tower 11, a water reservoir or well 12, a processing or pumping station 14, a water main 18 and branch lines 20 which carry the water from main 18. A plurality of valves, indicated by diagrammatic circles 22, are located at various places in the distribution system and are used to shut off the flow of water along its distribution line. In addition, water outlets 26, are also located at various places in the distribution system. Outlets 26 may take on a variety of forms including a fire hydrant. Water distribution systems such as 10 are conventional; they have many outlets such as 26 and cover a wide distribution area.

Figure 2:
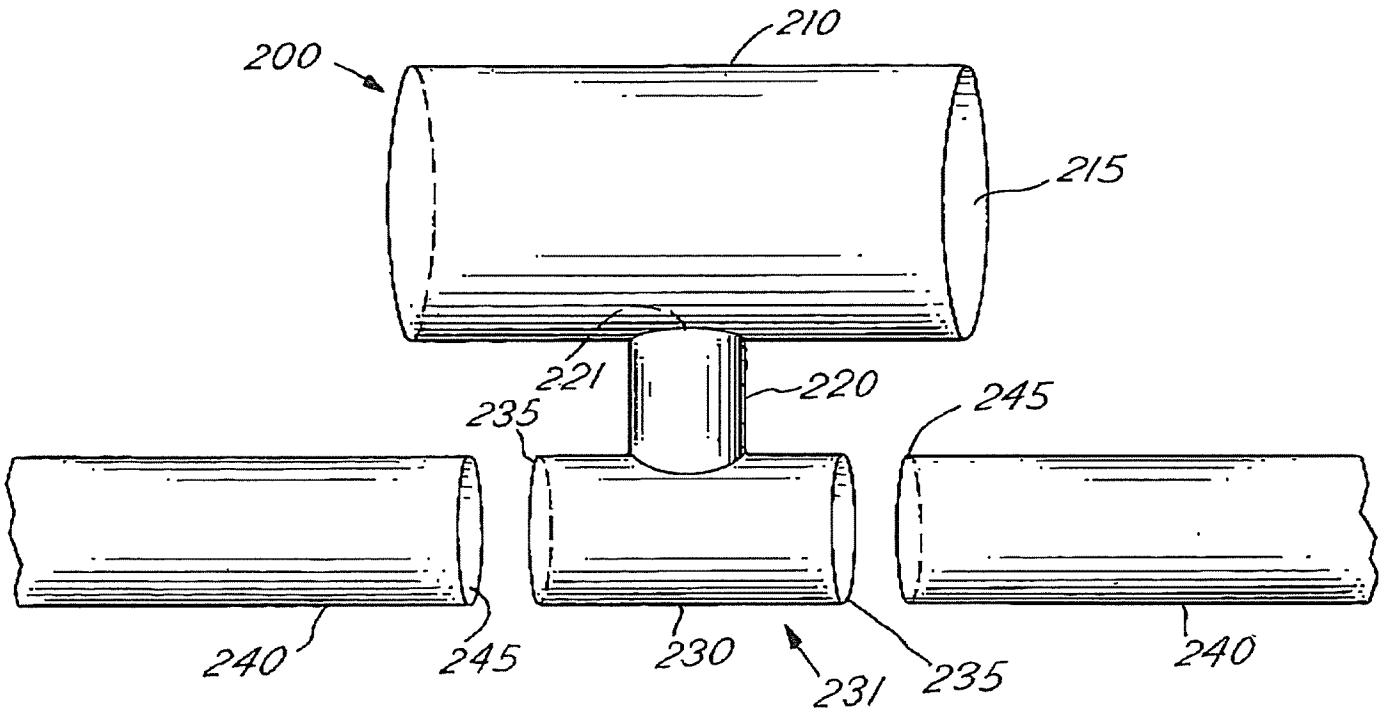
FIG. 2 is a side view of an embodiment of a surge suppressor tank apparatus, in accordance with the present invention.

Referring to FIG. 2, a surge suppressor apparatus 200 includes a surge suppressor tank 210 and tee pipe 231. Surge suppressor tank 210 is cylindrical in shape and includes end caps 215. Surge suppressor tank 210 and tee pipe 231 are manufactured as one piece. For example, surge suppressor tank 210 is welded to tee pipe 231. Surge suppressor apparatus 200 may be formed of cast iron, ductile iron, or plastic (e.g., polyvinyl chloride), as well as other materials as will suggest itself.

Surge suppressor apparatus 200 is connectable to a branch line or supply pipe 240 using a coupler (not shown), or a standard clamp (not shown), or the like. The coupler or standard clamp may be formed of stainless steel, cast iron, ductile iron or plastic, among other things. Tee pipe 231 includes a base 230 which may be manufactured in varying diameters in order to match the particular diameter of supply pipe 240 where a main break occurs. For example, base 230 is manufactured from cylindrical pipe having a diameter of either 4, 6, 8, 10, or 12 inches. The branch section 220 of tee pipe 231 may also be formed of cylindrical pipe and vary in diameter. In one embodiment, the diameter of the base 230 of the tee pipe is the same diameter as branch section 220.

Surge suppressor apparatus 200 is installed by cutting out and removing a section of the branch line or supply pipe 240. The cut out section of supply pipe 240 may be at the location of a break in the pipe, for example, caused by sudden pressure spikes in the water distribution system. Couplers or standard clamps may be used to connect the ends 235 of the tee pipe 231 to the cut out ends 245 of supply line 240. In one embodiment, surge suppressor apparatus 200 is installed so that surge suppressor tank 210 is vertically above supply line 240.

Surge suppressor tank 210 is formed of a hollowed cylindrical container. The ends of suppressor tank 210 may be sealed by end caps 215. End caps 215 may be welded, or otherwise securely attached to surge suppressor tank 210 to seal the tank. Suppressor tank 210 may have an opening 221 which leads to branch section 220 of the tee pipe. The horizontal length of surge suppressor tank 210 is approximately twice that of its diameter. Surge suppressor tank 210 provides a chamber of a predetermined volume which receives an increase in water volume during water surges.

Surge suppressor tank 210 is typically full of ambient air when the surge suppressor apparatus is installed. Air may be trapped within the surge suppressor tank 210. The end caps 215 of the surge suppressor tank 210 maintain an airtight seal. When water flows into the surge suppressor apparatus 200 via supply pipe 240 and through the base 230 of the tee pipe at a greater pressure than ambient air pressure, the water level may rise up through the branch section 220 and into the surge suppressor tank 210. The air within surge suppressor tank 210 may be compressed until pressure equilibrium occurs between the compressed air and the water flowing through base 230 of tee pipe 231. At pressure equilibrium, the water level maintains a vertical height within surge suppressor tank 210. In operation, upon a water surge, water is forced through branch section 220 of tee pipe 231 and into surge suppressor tank 210 against the compressed gas, compressing the gas even further. The surge suppressor tank thus serves as a shock absorber for the water surge.

In operation, one or more valves that are opened and/or closed rapidly may cause shockwaves of moving water through the water distribution system. If surge suppressor apparatus 200 were absent, the surge would act on, and possibly break or part, the mains within the water system. As will suggest itself, other surges can be caused by different flow characteristics in the line caused by pumps or other devices. After surge suppressor apparatus 200 is installed, however, the surge is diverted and arrested (or at least greatly attenuated) by surge suppressor tank 210 located above tee pipe 231. When a surge occurs, water is driven upward through branch section 220 of the tee pipe 231 and into surge suppressor tank 210. The air within surge suppressor tank 210 quickly compresses and then relaxes, absorbing the force of the surge.

Figure 3:
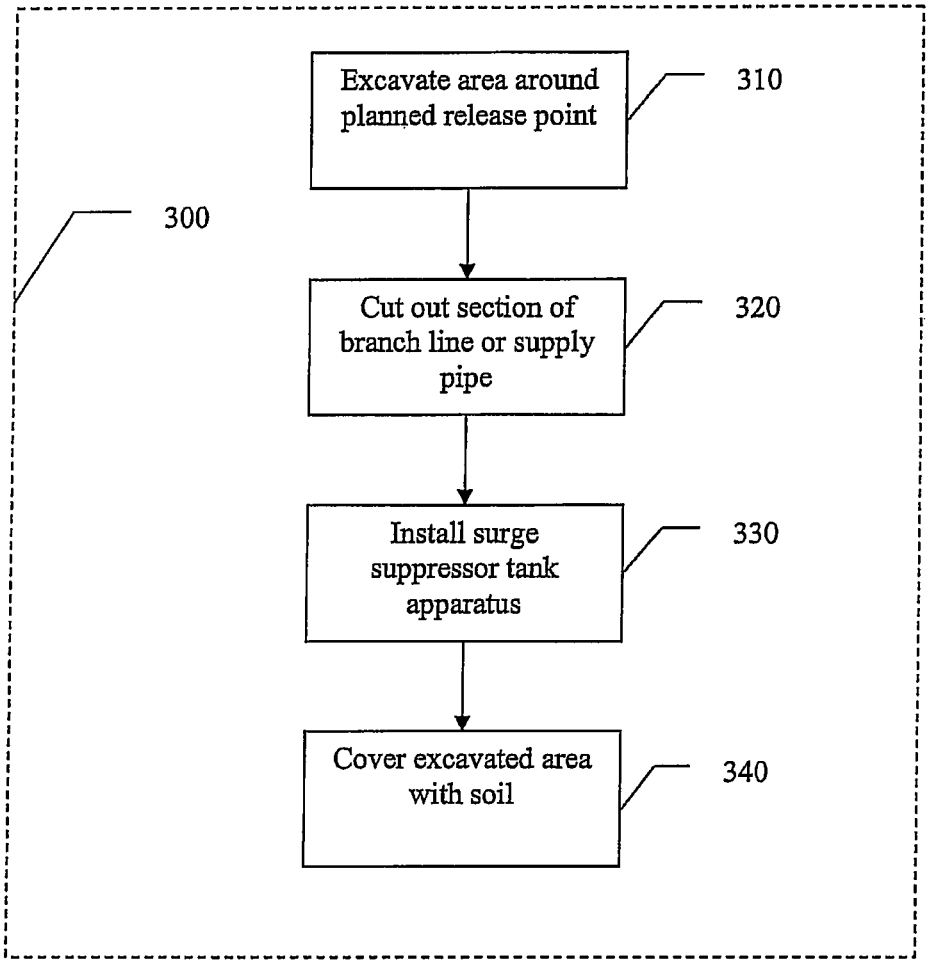
FIG. 3 is a flow chart of a method for installing the surge suppressor tank apparatus of FIG. 2.

FIG. 3 illustrates a flow chart of an exemplary method for installing a surge suppressor tank apparatus 200, in accordance with an embodiment of the present invention.

First, at step 310, the area surrounding a water release point in the water distribution system may be excavated. The water release point may be an area where a main break has already occurred, or the area may be chosen, in a preventive step, at a location so as to reduce the risk of future main breaks, among other things. Before excavating, water may need to be shut off using a shut-off valve (not shown) to stop water from passing through supply pipe 240. Once the water is shut off, the area surrounding the water release point may be excavated by removing the overburden of soil, for example.

At step 320, the section of supply pipe 240 is cut out and removed to provide an opening in the water distribution piping for receiving surge suppressor tank apparatus 200. The section of supply pipe 240 which is removed may be the approximate horizontal width of the surge suppressor tank apparatus 200. The section of supply pipe 240 that is cut out may be located where a main break has occurred or at the water release point, for example.

Next, at step 330, surge suppressor apparatus 200 is installed. The appropriate surge suppressor apparatus 200 is chosen based on the material (e.g., stainless steel, cast iron, ductile iron, plastic, etc.) forming apparatus 200. In addition, apparatus 200 is chosen based on the diameter of the supply pipe 240. A cast iron surge suppressor apparatus 200 may be chosen if supply pipe 240 is cast iron. Additionally, the diameter of base 230 of tee pipe 231 may be the same diameter as that of supply pipe 240.

In an embodiment, the ends 235 of the base 230 of tee pipe 231 are connected to the cut off ends 245 of supply pipe 240 by using standard clamps or couplers, or by welding together the joining ends 245 and ends 235 where the suppressor 200 is made from polyethylene, fusion welding of ends 245, 235 could be used. As understood, cast iron, PVC asbestos pipe, etc. is impossible to weld to a dissimilar material of the supply pipe 240. Surge suppressor apparatus 200 may be installed so that surge suppressor tank 210 is vertically above supply line 240.

Next, at step 340, the excavated area surrounding the installed surge suppressor apparatus is covered with soil. After filling in the excavated area, supply pipe 240, that was previously shut off, may be opened to permit water flow there through. The system once pressurized again may then be inspected for leaks prior to backfilling.

Referring to FIGS. 4*a*-4*c*, a surge suppressor apparatus 400 includes a surge suppressor tank 410 and tee pipe 417. Tee pipe 417 includes a base 430 which may be manufactured in varying diameters in order to match the particular diameter of a supply pipe (e.g., supply pipe 240, FIG. 2) where a main break occurs. For example, base 430 is manufactured from cylindrical pipe having a diameter of either 4, 6, 8, 10, or 12 inches. The branch section 420 of tee pipe 417 may also be formed of cylindrical pipe and vary in diameter. In an embodiment, the diameter of the base 430 of the tee pipe 417 is the same diameter as branch section 420. In an embodiment, the diameter, as referred to above, is measured using the inside diameter of the cylindrical pipe. Of course, engineering specifications may be met as to sizing the suppressor 400 to adapt to the particular supply pipe.

Surge suppressor tank 410 is cylindrical in shape and includes circular end caps 415. In certain embodiments, end caps 415 may be recessed from the outer ends of the cylindrical wall of tank 410, as shown at 450. For example, end caps 415 may be recessed 0.25 inches from the outer ends of tank 410. Surge suppressor tank 410 includes six (6) cross braces 405 (FIG. 4B) to prevent end caps 415 from bowing. As will suggest itself, other means or structural members may be used to reinforce end caps 415. Alternatively, tank 410 may be made similar to a conventional propane tank.

Surge suppressor tank 410 may include a test port 440 with an associated plug (not shown) for emptying the surge suppressor tank. For example, during a passavation process (citric acid bath) to coat the area of welds, the tank may be emptied. In another embodiment, port 440 may be used to test water/air ratios, among other things. However, the threaded connection between the port and plug must not allow air to escape. Surge suppressor apparatus 400 may be formed of stainless steel, for example. In addition, if apparatus 400 is made from carbon steel and an approved coating is used, the port and plug, and passavation are unnecessary.

Figure 5:
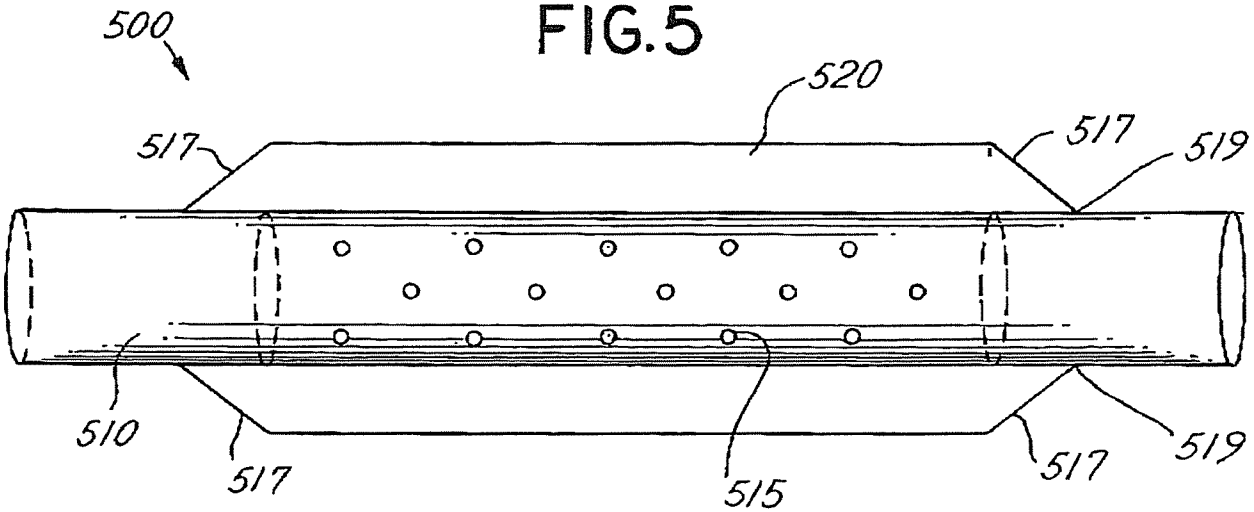
FIG. 5 is a side view of an embodiment of a surge suppressing pipe apparatus, in accordance with the present invention.

Referring to FIG. 5, a surge suppressing pipe apparatus 500 includes an inner pipe 510 and an outer pipe 520. Inner pipe 510 includes multiple perforations 515. In an embodiment, the multiple perforations may be of uniform size and/or shape, as for example, ¾ inch circular holes which permit water to pass between pipes 510, 520. Additionally, the multiple perforations may be uniformly placed on the inner pipe 510.

Outer pipe 520 is of a larger diameter and surrounds inner pipe 510. Pipe 520 is attached to inner pipe 510 via tapered ends 517 of outer pipe 520. The surge suppressing pipe apparatus 500 may be manufactured in varying diameters in order to match the diameter of inner pipe 510 to the diameter of a supply pipe (e.g., supply pipe 240, FIG. 2) where a main break occurs. For example, inner pipe 510 is manufactured from cylindrical pipe having a diameter of either 4, 6, 8, 10, or 12 inches. The outer pipe 520 may also be formed of cylindrical pipe and vary in diameter. For example, if the supply pipe where a main break occurs is 6 inches, a surge suppressing pipe apparatus 500 having an inner pipe 510 diameter of 6 inches and an outer pipe 520 diameter of 8 inches may be used. In an embodiment, the surge suppressing pipe apparatus is manufactured as one piece. In an embodiment, the diameter is measured using the inside diameter of the cylindrical pipe.

The attachment of the outer pipe 520 to the inner pipe 510 forms a seal. For example, outer pipe 520 may be welded to inner pipe 510.

Outer pipe 520 is filled with batting material for suppressing surges forces that occur from water passing through perforations 515 of the inner pipe. In an embodiment, the batting material may be closed cell foam plastic. Alternatively, a layer of foam may be applied between pipes 510, 520. In addition, air or another gas may fill a bladder that is disposed between pipes 510, 520. Also, the portion of inner pipe 510 may be eliminated and batting material or other suppressing material may be secured to the inside wall of pipe 520, as for example, where the pipes are made from polyethylene. Where the batting material is placed throughout the space between pipes 510, 520, the suppressing effect on surges will be more effective.

The ends of the inner pipe 510 extend beyond the tapered sealing attachment of the outer pipe 520 onto the inner pipe 510. For example, the ends of the inner pipe 510 may extend at least 4 inches beyond the attachment point 519 of the outer pipe 520 onto the inner pipe 510 to allow space for attaching the surge suppressing pipe apparatus 500 to a supply pipe (e.g., supply pipe 240). Surge suppressing pipe apparatus 500 may be formed of stainless steel, cast iron, ductile iron, or plastic (e.g., polyvinyl chloride), as well as other materials as will suggest itself.

In operation, one or more valves that are opened and/or closed rapidly may cause shockwaves of moving water through the water distribution system. If surge suppressing pipe apparatus 500 were absent, the surge would act on, and possibly break or part, the mains within the water system. As will suggest itself, other surges can be caused by different flow characteristics in the line caused by pumps or other devices. After surge suppressing pipe apparatus 500 is installed, however, the surge is diverted and arrested (or at least greatly attenuated) by the matted outer pipe 520 surrounding the perforated inner pipe 510. When a surge occurs, water is driven upward through perforations 515 of the inner pipe 510 and into matted outer pipe 520. The matting within outer pipe 520 quickly compresses and then relaxes, absorbing the force of the surge.

Thus, certain embodiments provide for a system and method for protecting a water distribution system from main breaks caused by sudden pressure spikes in the distribution system using a surge suppressor apparatus and/or a surge suppressing pipe apparatus. By using one or more of the surge suppressing apparatuses, municipalities may save time and money that may be spent fixing future main breaks. Certain embodiments provide for a cost efficient system and method for water surge protection.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method of providing surge protection to a water system having a horizontal water supply pipe portion having a diameter and being of cylindrical shape, said water supply pipe portion being buried horizontally beneath soil, the method comprising:

connecting a water surge suppressor apparatus in-line with the water supply pipe portion, said water surge suppressor apparatus comprising:

(1) a surge suppressor tank having a horizontally oriented cylinder defining an elongated, hollow, cylindrical airtight space when installed in the water system, wherein the horizontally oriented cylinder has a horizontal length that is approximately twice its diameter; and (2) a tee pipe integrally formed with said surge suppressor tank, said tee pipe having a horizontally oriented section that defines a horizontal flow path having substantially the same diameter as said water supply pipe portion, said tee pipe further having a vertical section defining a perpendicular flow path between the horizontally oriented section of said tee pipe and a lower opening in said surge suppressor tank, wherein said surge suppressor tank is oriented above and generally parallel to the horizontally oriented section of said tee pipe;

said step of connecting including:

excavating an area around a planned release point in the water supply pipe;

preventing a flow of water about the release point;

removing a section of said water supply pipe having a length corresponding to a length of the horizontally oriented section of said tee pipe;

connecting the horizontally oriented section of said tee pipe horizontally in-line with said horizontal water supply pipe portion where said section is removed while concurrently exposing the elongated, hollow, cylindrical airtight space of the horizontally oriented cylinder to ambient air pressure;

establishing a flow of water through the horizontal water supply pipe portion and tee pipe;

testing a water-to-air ratio in the surge suppressor tank through a port disposed through a top portion of the suppressor tank;

sealing the port with a plug to form an airtight seal between the port and the plug so that the horizontally oriented cylinder is airtight;

covering said area excavated with soil; and absorbing water pressure surges occurring in the horizontal water supply pipe portion through vertical compression of ambient air trapped within the hollow, elongated, cylindrical airtight space of the surge suppressor tank, wherein the vertical compression occurs along an interface between water entering the surge suppressor tank through the tee pipe and the ambient air trapped within the hollow, elongated, cylindrical airtight space, and wherein the interface extends along substantially the entire length of the hollow, elongated, cylindrical airtight space.

2. The method of claim 1 wherein said surge suppressor tank comprises a plurality of end caps at opposed ends of said horizontally oriented cylinder.

3. The method of claim 1 wherein said surge suppressor apparatus is formed of at least one of:

iron, ductile iron, and polyvinyl chloride.

4. The method of claim 1 wherein said tee pipe comprises:

a base forming the horizontally oriented section of said tee pipe, and a branch section forming the vertical section of the tee pipe.

5. The method of claim 4 wherein said base of said tee pipe is a diameter of at least one of:

four inches, six inches, eight inches, ten inches, and twelve inches.

6. The method of claim 3 wherein said surge suppressor apparatus is formed of a different material than the material forming said supply pipe.

7. The method of claim 1 wherein said tee pipe is welded to said surge suppressor tank.

8. The method of claim 2 wherein said plurality of end caps are welded to said surge suppressor tank.

9. The method of claim 1, further comprising:

removing the plug from the port to empty the surge suppressor tank; and subjecting the empty surge suppressor tank to a passivation process to coat at least a portion of the empty surge suppressor tank.

10. A method of providing water surge protection to a water distribution system having a horizontally oriented supply pipe having a diameter and buried beneath soil at a given location, said method comprising the steps of:

excavating an area around a planned release point in said horizontally oriented supply pipe;

removing a length of said supply pipe;

connecting a surge suppressor tank apparatus in-line with said supply pipe while exposing the surge suppressor tank to ambient air pressure, wherein the surge suppressor tank apparatus comprises:

a surge suppressor tank integrally formed with a tee pipe, said surge suppressor tank including a horizontally oriented cylinder defining an elongated, hollow, cylindrical airtight space when installed in the water system, wherein the horizontally oriented cylinder has a horizontal length that is approximately twice its diameter, wherein the elongated, hollow, cylindrical airtight space is pressurized to the ambient air pressure during connection of the surge suppressor tank, wherein said tee pipe includes a base defining a horizontal flow path in-line with said supply pipe, and a branch section defining a vertical flow path extending perpendicularly between said base and said surge suppressor tank, wherein said surge suppressor tank is oriented above and generally parallel to the base of said tee pipe;

testing a water-to-air ratio in the surge suppressor tank through a port disposed through a top portion of the surge suppressor tank;

testing a water-to-air ratio in the surge suppressor tank through a port disposed through a top portion of the suppressor tank;

sealing the port with a plug to form an airtight seal between the port and the plug so that the horizontally oriented cylinder is airtight;

covering with soil the excavated area; and absorbing water pressure surges occurring in the horizontally oriented supply pipe through vertical compression of ambient air trapped within the hollow, elongated, cylindrical airtight space of the surge suppressor tank, wherein the vertical compression occurs along an interface between water entering the surge suppressor tank and the ambient air trapped within the hollow, elongated, cylindrical airtight space, and wherein the interface extends along substantially the entire length of the hollow, elongated, cylindrical airtight space.

11. The method of claim 10 wherein said step of covering with soil the excavated area includes completely covering said surge suppressor tank.

12. The method of claim 10 wherein said step of connecting includes maintaining said surge suppressor tank above ground.

13. The method of claim 10 further comprising the step of choosing a surge suppressor apparatus, wherein said base of said tee pipe has a diameter that is substantially equal to said supply pipe.

14. The method of claim 10, further comprising:

removing the plug from the port to empty the surge suppressor tank; and subjecting the empty surge suppressor tank to a passivation process to coat at least a portion of the empty surge suppressor tank.

* * * * *

UNITED STATES PATENT AND TRADEMARK OFFICE

CERTIFICATE OF CORRECTION

PATENT NO. : 8,555,911 B2
APPLICATION NO. : 12/195833
DATED : October 15, 2013
INVENTOR(S) : Heil It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 676 days.

Signed and Sealed this
Thirty-first Day of March, 2015

Michelle K. Lee

Michelle K. Lee
*Director of the United States Patent and Trademark Office*